US008141169B2

(12) United States Patent
Saranga

(10) Patent No.: US 8,141,169 B2
(45) Date of Patent: Mar. 27, 2012

(54) LEG PROTECTION DEVICE

(76) Inventor: John Saranga, Lockport, IL (US)

( * ) Notice: Subject to any disclaimer, the term of this patent is extended or adjusted under 35 U.S.C. 154(b) by 0 days.

(21) Appl. No.: 12/322,725

(22) Filed: Feb. 2, 2009

(65) Prior Publication Data

US 2010/0192269 A1 Aug. 5, 2010

(51) Int. Cl.
*A41D 13/06* (2006.01)
*A41D 13/015* (2006.01)

(52) U.S. Cl. ..... 2/22; 2/24; 2/456

(58) Field of Classification Search ..... 2/455, 456, 2/22, 24

See application file for complete search history.

(56) References Cited

U.S. PATENT DOCUMENTS

| | | | | |
|---|---|---|---|---|
| 2,434,064 | A * | 1/1948 | Bredin | 2/22 |
| 3,669,105 | A * | 6/1972 | Castiglia | 602/16 |
| 3,735,419 | A * | 5/1973 | Byrd | 2/22 |
| 3,772,704 | A * | 11/1973 | Carbonneau | 2/22 |
| 3,787,892 | A * | 1/1974 | Quinn | 2/466 |
| 4,099,269 | A * | 7/1978 | Porner | 2/16 |
| 4,627,108 | A * | 12/1986 | Jarvinen | 2/22 |
| 4,691,697 | A * | 9/1987 | Arensdorf et al. | 602/16 |
| 4,700,403 | A * | 10/1987 | Vacanti | 2/462 |
| 4,756,026 | A * | 7/1988 | Pierce, Jr. | 2/16 |
| 4,926,501 | A * | 5/1990 | Goosen | 2/22 |
| 4,999,847 | A * | 3/1991 | Barcelo | 2/24 |
| 5,056,158 | A * | 10/1991 | Lutz | 2/22 |
| 5,090,055 | A | 2/1992 | McElroy | |
| 5,274,846 | A * | 1/1994 | Kolsky | 2/460 |
| 5,301,370 | A * | 4/1994 | Henson | 2/22 |
| 5,446,926 | A * | 9/1995 | Bourque et al. | 2/22 |
| 5,450,625 | A * | 9/1995 | Hu | 2/16 |
| 5,477,559 | A * | 12/1995 | Clement | 2/22 |
| 5,611,080 | A * | 3/1997 | Skottheim | 2/16 |
| 5,652,956 | A * | 8/1997 | Hoshizaki et al. | 2/22 |
| 5,711,028 | A * | 1/1998 | Bourque et al. | 2/22 |
| 5,920,901 | A * | 7/1999 | Tollini | 2/22 |
| 6,128,779 | A * | 10/2000 | Goldsmith et al. | 2/22 |
| 6,178,555 | B1 | 1/2001 | Williams | |
| 6,272,682 | B1 * | 8/2001 | Fullum | 2/22 |
| 6,405,383 | B2 | 6/2002 | Heller et al. | |
| 6,654,961 | B2 * | 12/2003 | Beland | 2/22 |
| 6,795,974 | B1 | 9/2004 | Howell | |
| 7,096,507 | B1 | 8/2006 | Bolden | |
| 7,197,770 | B1 | 4/2007 | Warren | |
| 7,237,276 | B2 | 7/2007 | Crye et al. | |
| 7,448,088 | B2 | 11/2008 | Miller | |
| 7,451,493 | B2 | 11/2008 | Godshaw | |
| 2002/0188997 | A1 * | 12/2002 | Lyden | 2/22 |
| 2004/0111780 | A1 * | 6/2004 | Lesosky | 2/24 |
| 2004/0154083 | A1 * | 8/2004 | McVicker | 2/455 |
| 2006/0041986 | A1 * | 3/2006 | Godshaw | 2/24 |
| 2007/0050877 | A1 | 3/2007 | Rampersad | |
| 2008/0021363 | A1 * | 1/2008 | Fee | 602/76 |
| 2008/0066272 | A1 * | 3/2008 | Hammerslag et al. | 24/712 |
| 2008/0072359 | A1 | 3/2008 | Godshaw et al. | |
| 2008/0168589 | A1 | 7/2008 | Richards | |

* cited by examiner

*Primary Examiner* — Bobby Muromoto, Jr.
(74) *Attorney, Agent, or Firm* — Maier & Maier, PLLC

(57) ABSTRACT

A lower leg protection device includes a knee protection section. A flanged shin protection section is flexibly connected to the knee protection section. At least one replaceable outer cushion is selectively secured to the knee protection section via a first strap, and at least one replaceable outer cushion is selectively secured to the shin protection section via a second strap.

13 Claims, 5 Drawing Sheets

LEG PROTECTION DEVICE

CROSS-REFERENCE TO RELATED APPLICATION

None.

BACKGROUND OF THE INVENTION

Protection gear for various purposes has been used throughout history. Hunting, traveling, warfare, and daily occupations led to the development of leather or fabric guards designed to protect parts of the body exposed to danger. These early body shields evolved as needs arose and materials developed, until today specialized protective gear exists for almost every imaginable human activity.

Of particular interest is the use of protective devices for the knee and lower leg. Such devices are typically used in skilled construction trades, for example, in the installation of tile and other floor coverings. These professions require their practitioners to spend long, strenuous hours of kneeling and crawling, and knee problems are considered to be an almost inevitable occupational hazard.

Knee protection devices for these and other purposes have been the subject of a high degree of inventive activity, as evidenced by the patent literature. For example, U.S. Pat. No. 7,451,493 shows a knee pad construction including a shaped cushion element with a concave interior with a recess having a flowable gel insert therein. The recess and insert are shaped to accommodate the left knee or the right knee of an individual.

U.S. Pat. No. 7,448,088 deals with a knee pad for attachment to a person's knee cap and an adjacent portion of the person's lower leg, comprising a cushioning pad that includes a forward section and a rearward section. The forward section has a knee well for receiving the person's knee cap and the knee well is off-center in the forward section. The rearward section of the cushioning pad has an interior concavity for receiving the person's lower leg.

U.S. Pat. No. 7,237,270 shows a garment having a pants leg with a front layer stitched along an outer peripheral seam to the pants leg to form a pocket with an interior cavity. The front layer has a central opening spaced from the outer peripheral seam and defined by an inner periphery. A protective insert, which may be formed of foam, and which is larger than the central opening, is removably positionable within the pocket. A stiff cap formed of a material such as SANTOPRENE® thermoplastic elastomer, is stitched to the insert. The cap has a flange which projects outwardly from a central region around a line of attachment. The central region is no larger than the pocket central opening. The insert is removably receivable within the pocket such that the inner periphery of the front layer is engaged between the stiff cap flange and the insert.

U.S. Pat. No. 7,197,770 involves a rolling kneepad having a weight transfer support assembly with swivel casters to support a user, a kneepad cushion provided above the support assembly to comfortably receive a user's knee, and a shin guard peripherally attached to the support assembly and extending outwardly therefrom. The elongated shin guard has a distal end which abuts the upper surface of a user's shoe or boot. Consequently, when the user moves from a kneeling to a standing position, the weight of the rolling kneepad is supported on the top surface of the user's shoe or boot. Downward slippage of the rolling kneepad along the user's leg is prevented and manual reposition of the rolling kneepad prior to the user resuming a kneeling position is avoided. Straps having hook and loop fasteners at the ends are typically used to affix the rolling kneepad to the body of the user.

U.S. Pat. No. 7,096,507 describes a lower leg appliance providing padding and cushion support for the knee, ankle and hip joints in the leg, by providing a hard surfaced knee pad, a hard surfaced ankle pad and a soft surface calf and thigh pad positioned between the calf and thigh, held in place by at least three adjustable straps having a closure means, the three pads working in conjunction to provide relief and support to a persons knees, ankles and hips while squatting or kneeling during chores, activities or labor.

U.S. Pat. No. 6,795,974 is directed to a kneeling pad assembly having an articulated supporting spine assembly with an upper spine member carrying a protected cushioned kneecup and a lower spine member carrying a shin engaging cushion. The pad assembly is supported on the leg of a user only by a pair of leg straps extending from the lower spine member behind the user's leg below the knee. The upper spine member is cantilevered above the lower spine and is constructed to be pivotally moveable with a snap action between two stable positions. The first stable position is with the upper spine collinear with the lower spine to hold the cushioned kneecup against the user's knee. The second stable position is with the upper spine member angled away from the user's leg at an acute angle to the lower spine member to hold the kneecap out of contact with the user's knee to avoid discomfort and displacement of the kneeling pad assembly during standing or walking.

U.S. Pat. No. 6,178,555 discloses a lower leg and foot cover for covering the knee and lower leg regions of a user's pants and the front of the user's shoes from soiling and soaking. The lower leg and foot cover includes a knee cover which is coupled to an upper end of a flexible lower leg cover. A flexible shoe cover is coupled to a lower end of the lower leg cover. Flexible straps are provided for securing the knee cover and the lower leg cover to the wearer's leg.

U.S. Pat. No. 6,405,383 is directed to a leg protective system selectively covering a person's lower leg and knee for protective against environmental elements. The leg protective system comprises a first protective cover and a second protective cover which are selectively attachable to each other to define a single leg protective system. The first protective cover is adapted to cover the front and side portions of a wearer's knee. The first protective cover has a top portion and a bottom portion, whereby the top and bottom portions are formed of a flexible material for generally fitting the contour of the knee. The bottom portion has a first releasable strap assembly adapted to extend behind the wearer's leg to operatively attach the first protective cover over the knee. The second protection cover is adapted to cover the front and side portions of a wearer's lower leg. The second protective cover is formed of a flexible material for generally fitting the contour of the lower leg. The second protective cover has a second releasable strap assembly adapted to extend behind the wearer's lower leg to operatively attach the second protective cover to the lower leg. The first and second protection covers are selectively attachable adjacent their respective bottom and top edges to define, when so attached, a single leg system.

U.S. Pat. No. 5,652,956 discusses a shin pad in which the shin shield is in two pieces, namely an upper piece which is secured to the lining of the knee cap, or to the knee cap itself, and a lower piece which is slidable up and down relative to the upper piece, and to which a lower liner is secured, the lower liner being independent of the knee liner. Preferably, the lower piece is slidable with respect to the upper piece by virtue of one or more slotted holes in either or both of the upper piece and/or lower piece, with bolts and T-nuts being used in the slots to secure the pieces together in the desired position. Preferably, there are three such slotted holes, namely a front central one and two side ones, namely one towards either side of the pad. Preferably, there is sufficient sloppiness in the slots to provide a varus/valgus adjustment, i.e. an adjustment of the angle of the shin shield, in the vertical fore-and-aft plane, relative to the orientation of the knee cap, by permitting the lower piece to be secured with one side higher than the other relative to the upper piece.

U.S. Pat. No. 5,090,055 concerns a unique protective knee pad which is comprised of one-piece molded resilient polyurethane foam. The pad has a special U-shaped sole with a transverse bar through the middle portion and a transverse bar at the rear. Two cavities are created by the transverse bars which are adapted to entrap air when the wearer is in the operative kneeling position thereby cushioning the delicate parts of the patella and upper shin, by preventing the outwardly extending portion of the knee from coming into contact with the ground.

U.S. Patent Publication No. 20080168589 deals with a knee pad with a support frame, a pad, and a boot. The pad is assembled on the support frame to provide a cushioning surface between the support frame and the wearer's leg. The pad has ears in the knee section and in the ankle section, which serve to maintain the support frame and pad in proper alignment on the leg. The boot provides a non-slip, non-marring surface against the floor, when the wearer is working in a kneeling position. A moisture-absorbent liner, which is easily removed for cleaning or replacement, may also be fitted on top of the pad, to provide an absorbent layer between the pad and the wearer's leg.

U.S. Patent Publication No. 20080072359 shows protective knee pads. The knee pads are comprised of a first shell member which fits over the patella and knee joint and a second member which is attached to the lower thigh and pivotally engaged with the knee pad shell so that they may articulate one with respect to the other while providing additional support and protection for the user of the knee pad. An additional shin pad may also be attached to the lower end of the shell which covers the knee.

U.S. Patent Publication No. 20070050877 shows a clothing adherable knee pad for a pair of shorts including a bendable flexible arcuate pad which bends over the knee of a kneeling person. The knee pad is cantilevered downward from at least two linearly extending elastic, stretchable straps which are connected at distal ends thereof each to a respective clothing engageable clip at upper region of the knee pad, wherein each clip is attachable to a leg of a pair of short pants. The two or more linearly extending elastic, stretchable straps engage the knee pad by being attached thereto or by being woven through respective pairs of slits extending through the upper region of the knee pad. The straps are of sufficient length so that when attached to clothing, such as short pants, respective locations of the clips upon short pants legs avoids uncomfortable encroachments to respective lateral and rear areas of the knee of the user.

It can be seen from the foregoing that the need exists for knee pad that provides a durable, inexpensive, easily manufactured, and comfortable pad adapted to a wide variety of potential uses.

SUMMARY OF THE INVENTION

A lower leg protective device includes a knee protection section. A flanged shin protection section is flexibly connected to the knee protection section. At least one replaceable outer cushion is selectively secured to the knee protection section via a first strap, and the at least one replaceable outer cushion is selectively secured to the shin protection section via a second strap.

BRIEF DESCRIPTION OF THE DRAWINGS

Embodiments of the invention are illustrated by way of example, and not by way of limitation, in the figures of the accompanying drawings and in which like reference numerals refer to similar elements and in which.

DETAILED DESCRIPTION OF THE INVENTION

Figure 1:
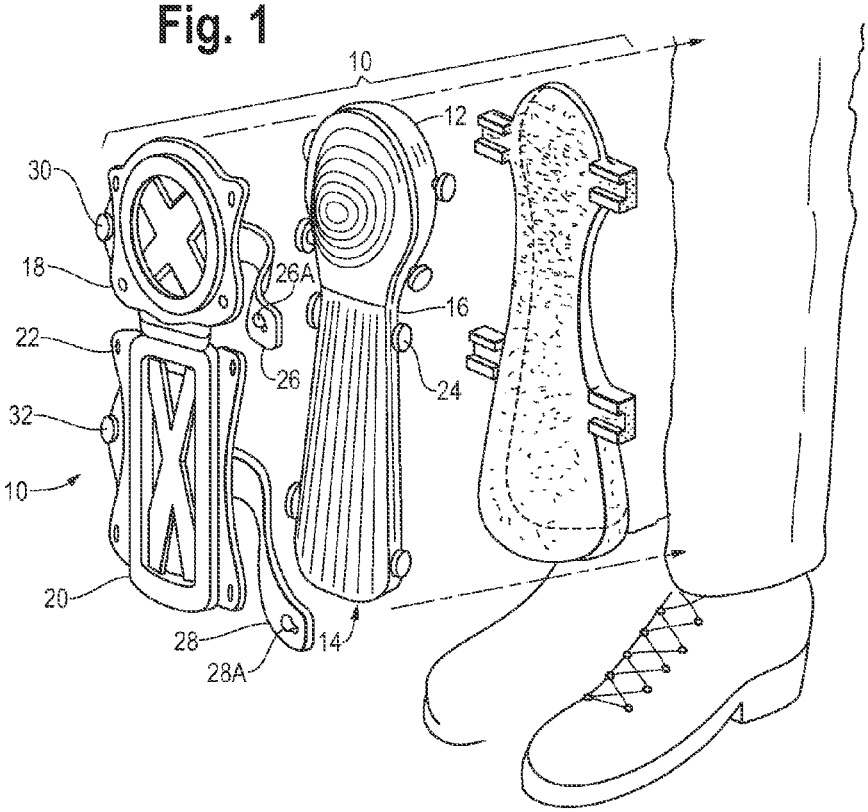
FIG. 1 illustrates a perspective view of an embodiment of a leg protection device in accordance with the principles of the present invention.

In the following description, specific details are set forth in order to provide a thorough understanding of the invention. However, it will be apparent that the invention may be practiced without these specific details. Without departing from the generality of the invention disclosed herein and without limiting the scope of the invention, the discussion that follows will refer to the invention as depicted in the drawings.

Figure 2:
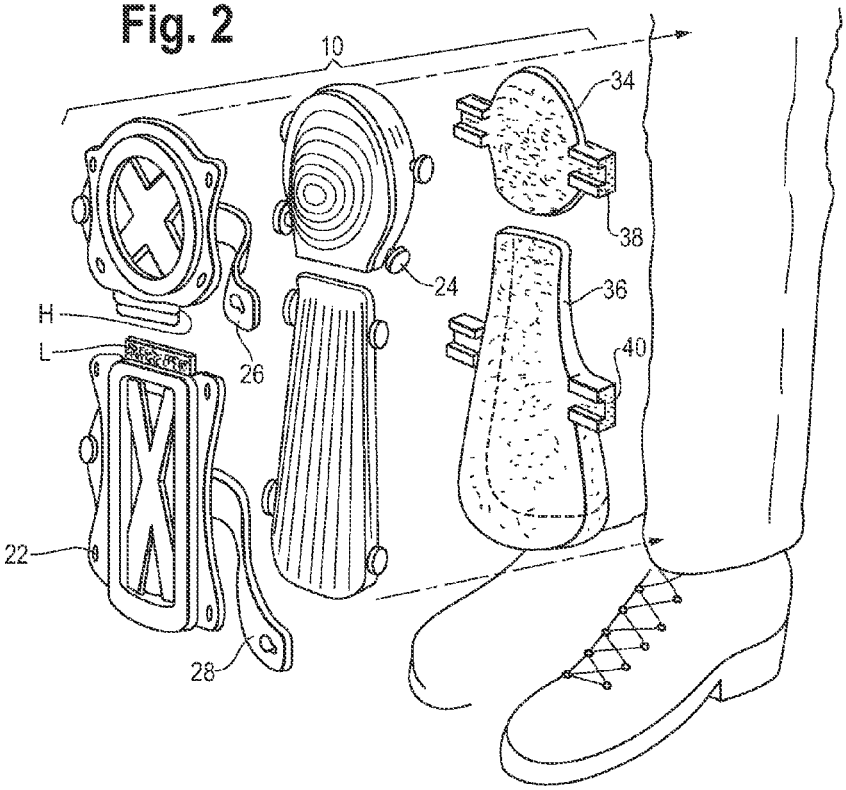
FIG. 2 illustrates a perspective view of an embodiment of a leg protection device having detachable shin protection section in accordance with the principles of the present invention.
Figure 4:
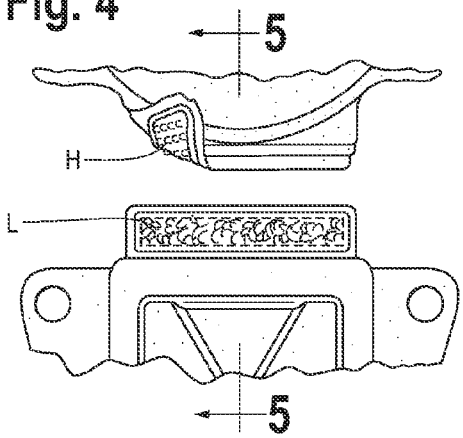
FIG. 4 illustrates a detailed sectional view of a detachable embodiment of the replaceable outer cushions of the FIG. 1 device.

An embodiment of a lower leg protection device 10 in accordance with the principles of the present invention is shown in FIGS. 1 and 2. The lower leg protection device 10 includes a knee protection section 12 and a flanged shin protection section 14. The flanged shin protection section 14 is flexibly connected to the knee protection section 12, here illustrated as via an accordion-style section 16. It is also contemplated that the shin protection section 14 can be detachably connected to the knee protection section 12 in a conventional manner, as by hook and loop fasteners H, L (FIGS. 2, 4). The shin protection section 14 and the knee protection section 12 can be fabricated from any suitable material, such as hard rubber or hard plastic.

The leg protection device 10 is provided with at least one of replaceable outer cushions 18, 20 selectively secured to the shin protection section 14 and knee protection section 12. The replaceable outer cushions 18, 20 are provided with openings 22 corresponding in size and location to attachments 24 provided on the outside of the leg protection device 10. Suitable attachments 24 can include, for example, pegs, metal snaps, plastic snaps, butter snaps, or any other suitable fastening device. Further, the attachments 24 can be formed from rubber, plastic, metal, fabric, or any other suitable material. Using this configuration, the replaceable outer cushions 18, 20 are secured to the protection device 10 via the attachments 24 and first and second straps 26, 28.

Figure 3:
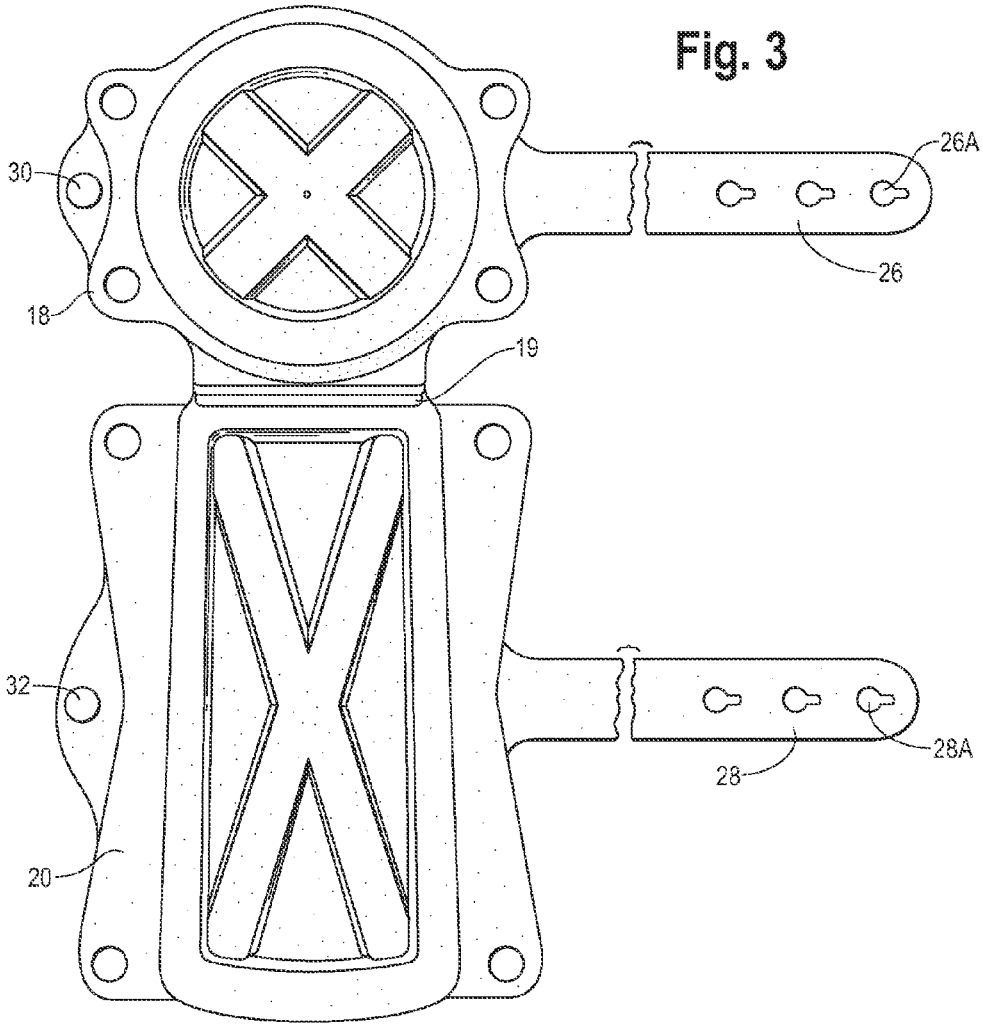
FIG. 3 illustrates a front elevational view of the replaceable outer cushions and first and second straps of the FIG. 1 device.
Figure 5:
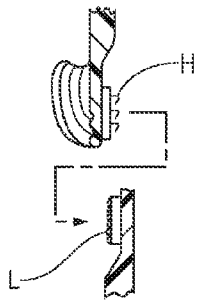
FIG. 5 illustrates a sectional view taken generally along lines 5-5 of FIG. 4.

The replaceable outer cushions 18, 20 can be flexibly connected via a connection 19, as illustrated in FIG. 3. The connection 19 can be a detachable or frangible connection, and can be selectively connected via, for example, hook and loop fasteners H, L as illustrated in FIGS. 2, 4 and 5. Alternatively, outer cushions 18, 20 can be provided as separate units.

A suitable attachment mechanism can be provided on the outer cushions 18, 20. As illustrated in FIG. 1, for example, attachment mechanisms 30, 32 are provided for selectively securing one of the strap attachments 26A, 28A of the respective straps 26, 28 of the replaceable outer cushions 18, 20. As shown in FIG. 1, pegs can be provided as attachment mechanisms 30, 32 while apertures are provided as the strap attachments 26A, 28A. Other suitable attachment mechanisms can include, for example, snaps, plastic fasteners, or any other fastener that secures the straps via the strap attachments 26A, 28A to the attachment mechanisms 30, 32.

Internal padding elements 34, 36 are provided inside the knee protection section 12 and the shin protection section 14. The internal padding elements 34, 36 each include a pair of strap contact flanges 38, 40 at the peripheral edges of the knee protection section 12 and the shin protection section 14, respectively, to both reduce pressure on the anterior and posterior tibular arteries of the user and to reduce the pressure on the legs caused by known strap configurations.

Figure 6:
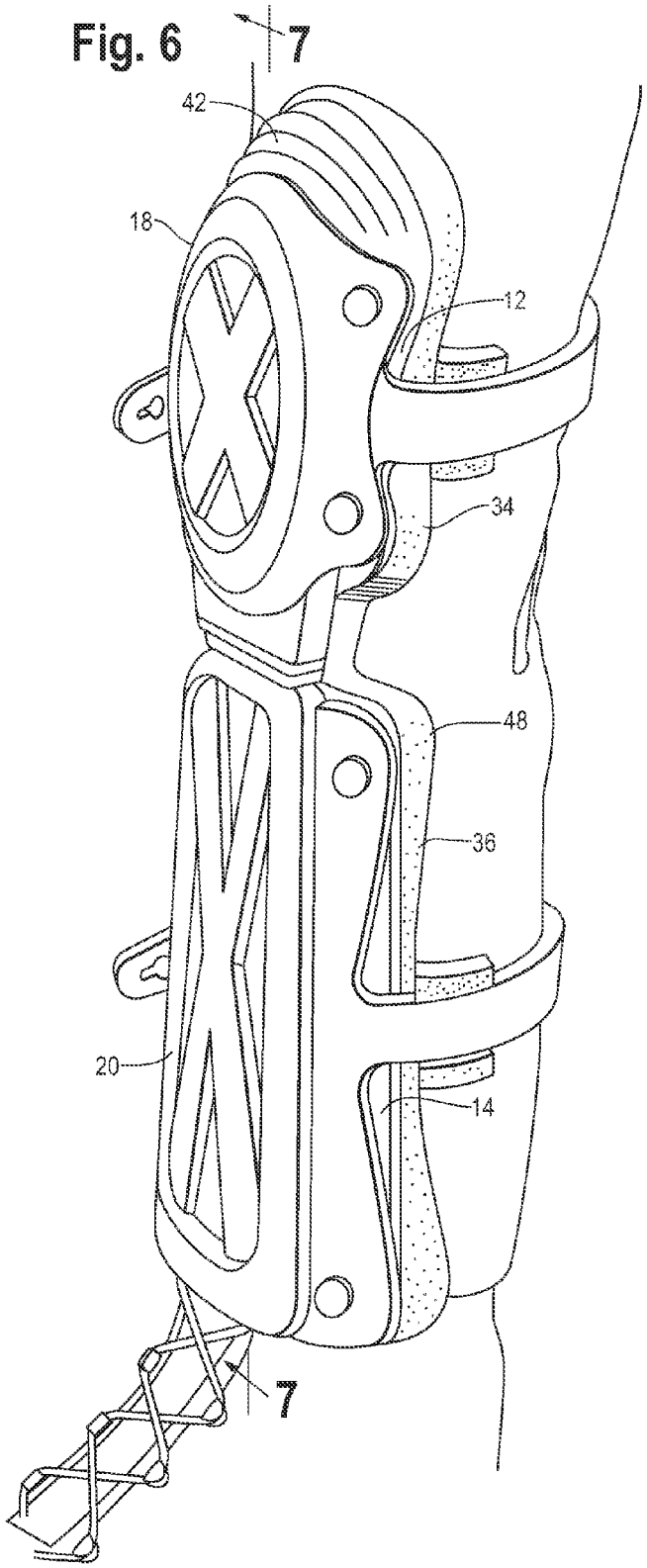
FIG. 6 illustrates a perspective view of the leg protection device in accordance with the principles of the present invention.
Figure 7:
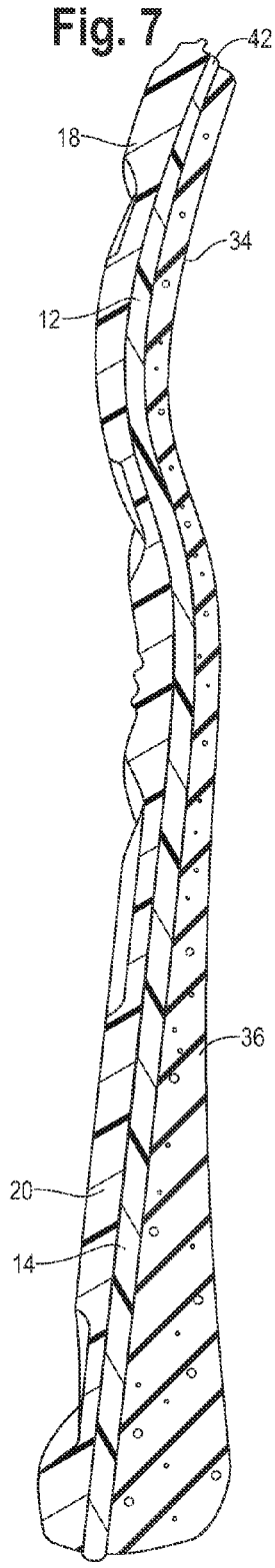
FIG. 7 illustrates a detailed sectional of the leg protection device of FIG. 6 taken generally along lines 7-7.
Figure 8:
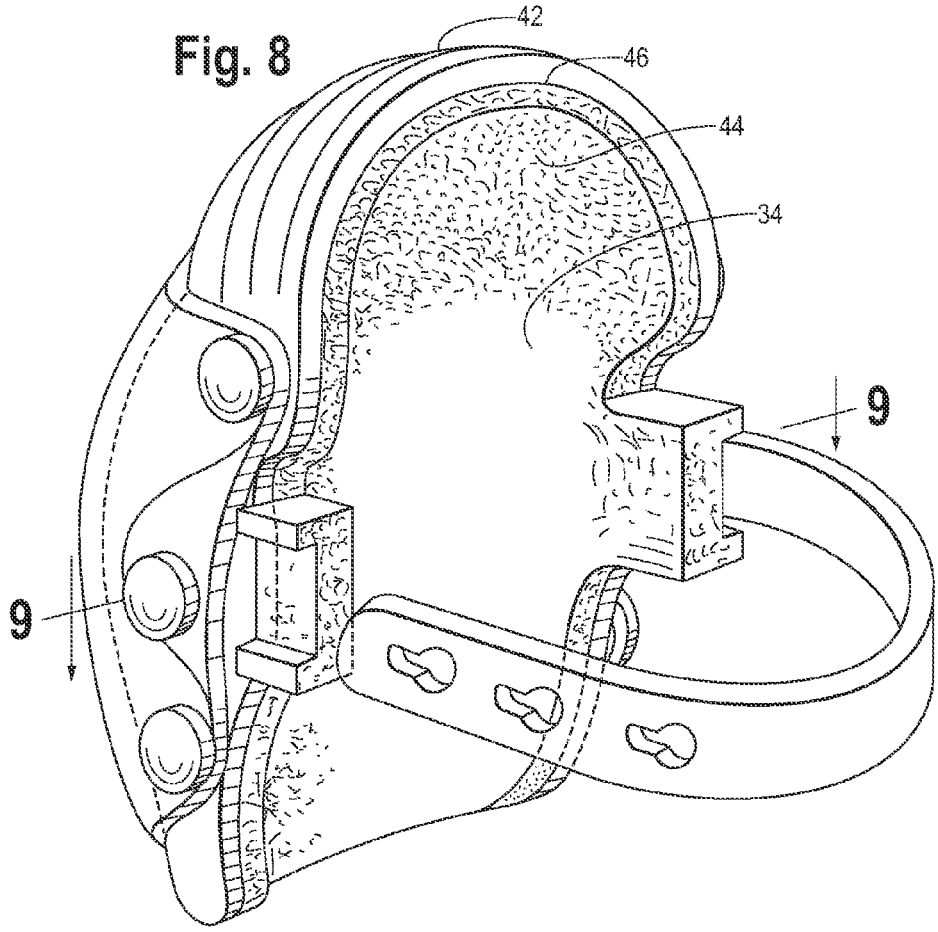
FIG. 8 illustrates a perspective interior view of a knee pad of the FIG. 1 device.
Figure 9:
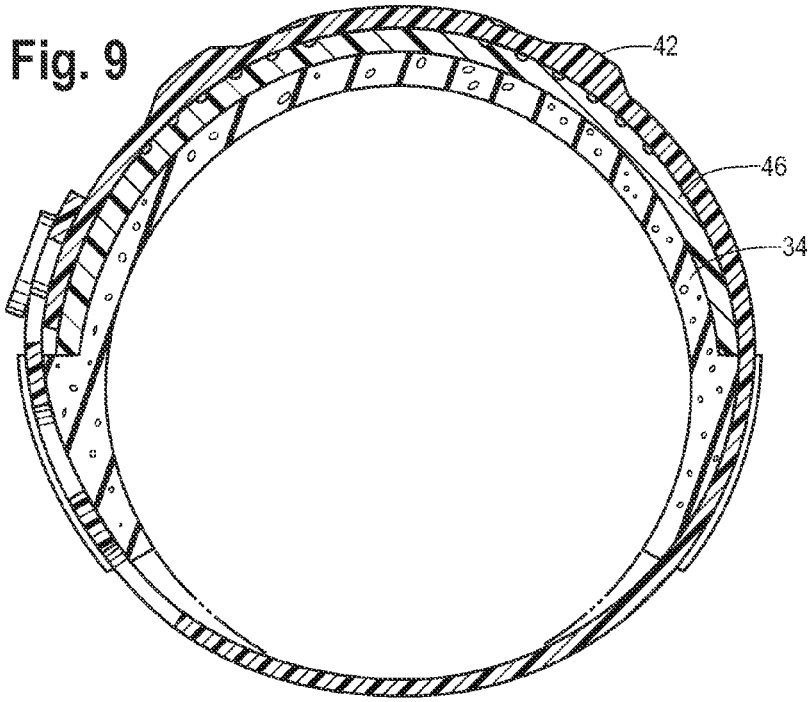
FIG. 9 illustrates sectional view taken generally along lines 9-9 of FIG. 8.
Figure 10:
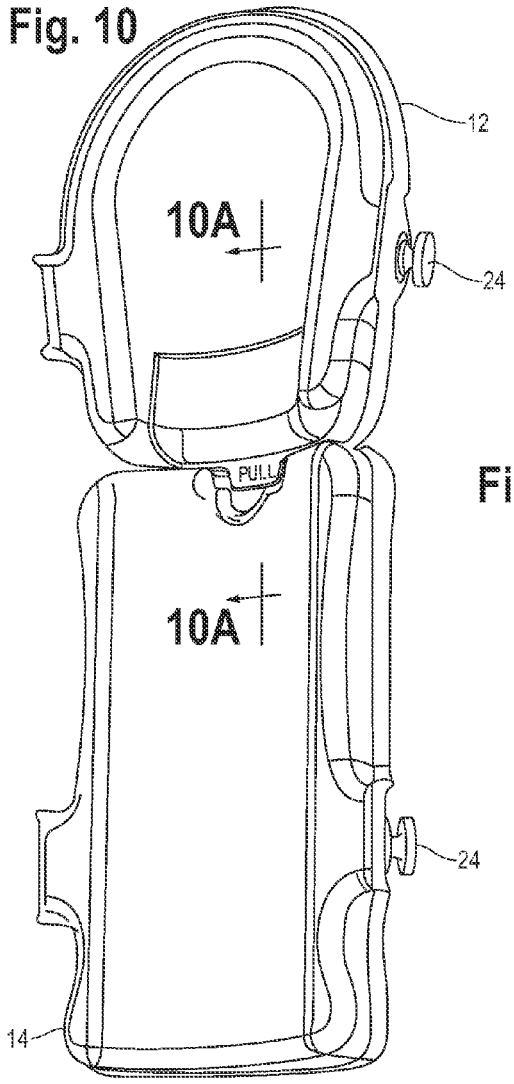
FIG. 10 illustrates the backside of the present invention.
Figure 11:
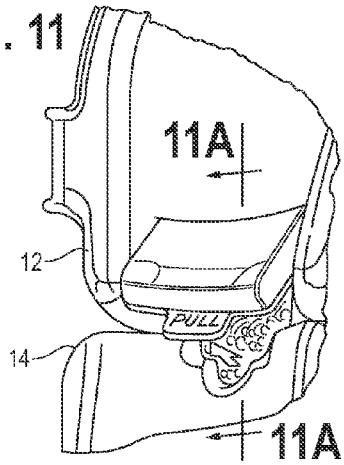
FIG. 11 illustrates a rear view of the top portion of the present invention.
Figure 12:
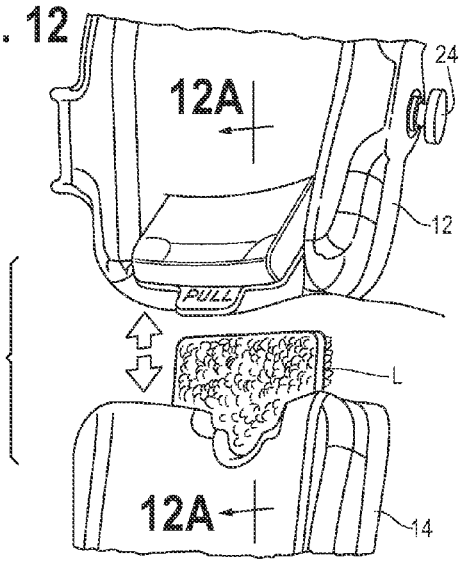
FIG. 12 illustrates the separation of the upper and lower sections of the leg protection device of the present invention.
Figure 10A:
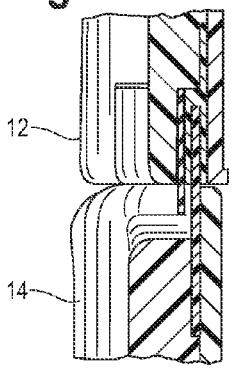
FIG. 10A illustrates a sectional view taken generally along lines of 10A-10A in FIG. 10
Figure 11A:
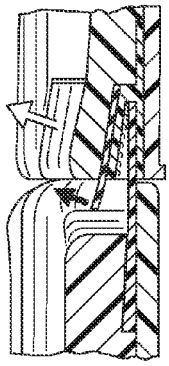
FIG. 11A illustrates a sectional view taken generally along lines of 11A-11A of FIG. 11.
Figure 12A:
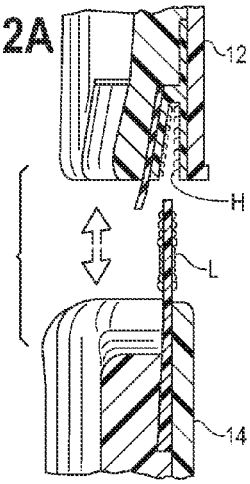
FIG. 12A illustrates a side sectional view of the upper and lower sections of the present invention taken generally along the lines of 12A-12A of FIG. 12.

Further, as illustrated in FIG. 8 and FIG. 9 the internal padding element 34 includes an upper patella protection section 44 that extends up to an edge 46 of an upper section 42 of the knee protection section 12. In addition, the internal padding element 36 includes an outwardly flanged shin adjustment section 48 as illustrated in FIG. 6. The outwardly flanged shin adjustment section 48 serves to provide an improved weight distribution system for the portion of the leg below the knee. As a result, the outwardly flanged shin adjustment section 48 takes pressure off the knee caps by flaring out over the shin bone, and allows the user to lean back farther the possible with known knee pads. The internal padding elements 34, 36 are fabricated from a suitable material having sufficient cushioning properties and durability. It is contemplated that materials such as foam rubber, plastic, and shock-absorbing gel paks will suffice. Further, the padding can be securely attached, such as with glue, or removable attached, such as with pegs, Velcro, or any other suitable attachment wherein layers are held firmly and closely together, as illustrated in FIG. 7.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim as my invention:

1. A lower leg protection device comprising the following:

a knee protection section;

a flanged shin protection section flexibly connected to the knee protection section, the flanged shin protection section having a flanged shin adjustment section that flares outward;

internal padding inside the knee protection section, the internal padding including a pair of strap contact flanges at the peripheral edge of the knee protection section; and internal padding inside the shin protection section, the internal padding including a pair of strap contact flanges at the peripheral edge of the shin protection section a flap on a lower portion of the internal padding inside the knee protection section, the flap exposing a first attachment means disposed on an inner surface of the flap and a second attachment means disposed on an inner surface of the knee protection section, wherein the first attachment means are hooks and the second attachment means are loops; and an attachment tab on an upper portion of the shin protection section, the attachment tab comprising a third attachment means disposed on an inner surface of the attachment tab and a fourth attachment means disposed on an outer surface of the attachment tab, wherein the third attachment means are loops and the fourth attachment means are hooks, wherein the flap is adapted to receive the attachment tab, such that the first attachment means attaches to the third attachment means and the second attachment means attaches to the fourth attachment means.

2. The lower leg protection device in accordance with claim 1, wherein at least one of the knee protection section and the shin protection section is provided with a plurality of pegs adapted and constructed to secure at least one of a first strap and a second strap to the protection device.

3. The lower leg protection device in accordance with claim 1, the internal padding of the leg protection device further including an upper patellar protection extension.

4. The lower leg protection device in accordance with claim 1, wherein the internal padding is fabricated from a material chosen from a group consisting of foam rubber, plastic, and shock-absorbing gel paks.

5. A lower leg protection device in accordance with claim 1, further comprising an internal padding having an outwardly flanged shin adjustment section.

6. The lower leg protection device in accordance with claim 1, wherein the internal padding is fabricated from a material chosen from a group consisting of foam rubber, plastic, and shock-absorbing gel paks.

7. The lower leg protection device in accordance with claim 1, wherein the knee protection section and shin protection section are fabricated from hard plastic.

8. The lower leg protection device in accordance with claim 1, wherein the knee protection section and shin protection section are fabricated from hard rubber.

9. The lower leg protection device in accordance with claim 2, wherein the straps are fabricated from rubber.

10. A lower leg protection device comprising:

a knee protection section; and a flanged shin protection section flexibly connected to the knee protection section, the flanged shin protection section having a flanged shin adjustment section that flares outward;

a flap on the knee protection section, the flap exposing a first attachment means and a second attachment means, wherein the first attachment means are hooks and the second attachment means are loops; and an attachment tab on the shin protection section, the attachment tab comprising a third attachment means and a fourth attachment means wherein the third attachment means are loops and the fourth attachment means are hooks, wherein the flap is adapted to receive the attachment tab, such that the first attachment means attaches to the third attachment means and the second attachment means attaches to the fourth attachment means, wherein the knee protection section is detachably connected to the flanged shin protection section.

11. The lower leg protection device of claim 10, wherein the flanged shin protection section is flexibly connected to the knee protection section by hook and loop fasteners.

12. The lower leg protection device of claim 11 wherein the shin protection section and the knee protection section are fabricated from any suitable material such as hard rubber or hard plastic.

13. The lower leg protection device in accordance with claim 1, further comprising a pull tab on the flap.

* * * * *